US012359665B2

(12) United States Patent
Long et al.

(10) Patent No.: US 12,359,665 B2
(45) Date of Patent: Jul. 15, 2025

(54) VACUUM PUMP WITH REDUCED SEAL REQUIREMENTS

(71) Applicant: Edwards Limited, Burgess Hill (GB)

(72) Inventors: Cainan Long, Burgess Hill (GB); Nigel Paul Schofield, Burgess Hill (GB); Alan Ernest Kinnaird Holbrook, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 18/721,793

(22) PCT Filed: Dec. 16, 2022

(86) PCT No.: PCT/GB2022/053270
§ 371 (c)(1),
(2) Date: Jun. 19, 2024

(87) PCT Pub. No.: WO2023/118819
PCT Pub. Date: Jun. 29, 2023

(65) Prior Publication Data

US 2025/0052241 A1 Feb. 13, 2025

(30) Foreign Application Priority Data

Dec. 23, 2021 (GB) ..... 2118904

(51) Int. Cl.
*F04C 27/00* (2006.01)
*F04C 15/00* (2006.01)
(Continued)

(52) U.S. Cl.
CPC ..... *F04C 27/001* (2013.01); *F04C 15/0034* (2013.01); *F04C 18/126* (2013.01);
(Continued)

(58) Field of Classification Search
CPC .. F04C 27/001; F04C 15/0034; F04C 18/126; F04C 25/02; F04C 27/008; F04C 29/04
See application file for complete search history.

(56) References Cited

U.S. PATENT DOCUMENTS 3,922,117 A 11/1975 Weatherston
4,990,069 A 2/1991 Guittet et al.
(Continued)

FOREIGN PATENT DOCUMENTS

CN 213511094 U 6/2021
CN 110753793 A 2/2022
(Continued)

OTHER PUBLICATIONS

Machine Translation with foreign patent publication for CN 213511094 U: Inventor: Zhang; Title: Vacuum Pump with Explosion-proof Structure; Published: Jun. 22, 2021. (Year: 2021).*
(Continued)

*Primary Examiner* — Mary A Davis
(74) *Attorney, Agent, or Firm* — Shumaker & Sieffert, P.A.

(57) ABSTRACT

The present disclosure relates to vacuum pump 10 comprising a substantially hermetically sealed enclosure 40, a core pump assembly located within the enclosure 40, and an inert purge gas inlet 70 fluidly connected to the enclosure 40 for supplying inert purge gas to an interior of the enclosure 40 surrounding the core pump assembly. By providing a sealed enclosure 40 around the core pump assembly and supplying inert purge gas thereto via the inlet 70, an inert positive pressure can be applied to the core pump assembly that reduces leakage of process gas from the core pump assembly such that seals therein can be removed or reduced. In particular, the need for elastomer seals that may be expen-
(Continued)

sive and not be suited to high temperature or corrosive process gas conditions can be removed.

13 Claims, 3 Drawing Sheets

(51) Int. Cl.
*F04C 18/12* (2006.01)
*F04C 25/02* (2006.01)
*F04C 29/04* (2006.01)

(52) U.S. Cl.
CPC ..... *F04C 25/02* (2013.01); *F04C 27/008* (2013.01); *F04C 29/04* (2013.01)

(56) References Cited

U.S. PATENT DOCUMENTS

| | | | | |
|---|---|---|---|---|
| 6,471,497 | B2 * | 10/2002 | Suzuki | F04C 29/0092 418/9 |
| 9,279,426 | B2 | 3/2016 | Schofield et al. | |
| 11,542,946 | B2 | 1/2023 | Turner et al. | |
| 2010/0226808 | A1 | 9/2010 | Schofield et al. | |
| 2020/0124050 | A1 | 4/2020 | Turner et al. | |
| 2022/0120279 | A1 * | 4/2022 | Decorde | F04C 25/02 |

FOREIGN PATENT DOCUMENTS

| | | | |
|---|---|---|---|
| JP | H02157490 | A | 6/1990 |
| JP | 2001304115 | A | 10/2001 |
| JP | 2002221157 | A | 8/2002 |
| JP | 2010506096 | A | 2/2010 |
| JP | 2010540832 | A | 12/2010 |
| JP | 2020524242 | A | 8/2020 |
| WO | 2004099620 | A1 | 11/2004 |
| WO | 2008044064 | A2 | 4/2008 |
| WO | 2009044197 | A2 | 4/2009 |
| WO | 2018138487 | A1 | 8/2018 |
| WO | 2018138489 | A1 | 8/2018 |

OTHER PUBLICATIONS

Machine Translation and Chinese Patent Publication for CN 110753793 A, Inventor: Turner et al; Title: Double-shaft Pump; Published: Feb. 4, 2020. (Year: 2020).*

Combined Search and Examination Report from GB Application No. 2118904.8, dated May 25, 2022, 6 Pages.

International Search Report and Written Opinion of International Application No. PCT/GB2022/053270, dated Mar. 29, 2023, 13 Pages.

Notification of Reason for Refusal, and translation thereof, from counterpart Japanese Application No. 2024-536451 dated Apr. 21, 2025, 6 pp.

* cited by examiner

VACUUM PUMP WITH REDUCED SEAL REQUIREMENTS

This application is a national stage entry under 35 U.S.C. § 371 of International Application No. PCT/GB2022/053270, filed Dec. 16, 2022, which claims the benefit of GB Application No. 2118904.8, filed Dec. 23, 2021, the entire contents of each of which are incorporated herein by reference.

TECHNICAL FIELD

The present disclosure relates to a vacuum pump that can allow for seals between the stator halves or between the stator halves and their end plates to be removed.

BACKGROUND

Vacuum pumps are typically employed as a component of a vacuum system to evacuate working gases from the system. These pumps can be used to evacuate fabrication equipment used in, for example, the production of semiconductors. Rather than performing compression from a vacuum to atmosphere in a single stage using a single pump, it is common in such applications to provide multi-stage vacuum pumps where each stage performs a portion of the compression range required to transition from a vacuum to atmospheric pressure. Furthermore, in many vacuum pump applications, the working or process gas needs to be kept above a minimum temperature to avoid the gas condensing into a liquid or solid, which can harm pump operation.

SUMMARY

A multi-stage vacuum pump can generally have a clamshell construction, which may include the use of two stator shell halves and two end plates on the two sides of the stator halves to enclose the pumping area. Traditionally, longitudinal and annular seals are used between the two stator halves and between the stator halves and the two end plates, respectively, to prevent leakages between the pump and the surrounding environment. Generally, elastomer seals are used for this purpose, but it can be challenging to achieve an effective sealing system to seal these interfaces. Previous solutions include sealing stator shells using elastomer seals. However, there are applications where elastomer seals are not desirable. For example, they may be susceptible to degradation and loss of sealing at particular service temperatures and under particular corrosive process gas environments. They may also be susceptible to outgassing and have unacceptable gas permeability under particular conditions. Moreover, the use of elastomer seals with the necessary sealing performance for a particular application can provide increased expense and complexity.

Therefore, a vacuum pump with clamshell construction that can remain sealed in such applications and avoid or reduce the need for elastomers seals is desired to overcome these limitations.

According to an aspect of the present disclosure, there is a vacuum pump comprising: a substantially hermetically sealed enclosure; a core pump assembly located within the enclosure and comprising two stator halves that are joined to define a plurality of pump chambers therein; and an inert purge gas inlet fluidly connected to the enclosure for supplying inert purge gas to an interior of the enclosure surrounding the core pump assembly.

It has been found that by providing a sealed enclosure around the core pump assembly and supplying inert purge gas thereto via the inlet, an inert positive pressure can be applied to the core pump assembly that reduces leakage of process gas from the core pump assembly such that seals therein can be removed or reduced. This can make the core pump assembly more suitable for use in higher temperature or more corrosive operating environments where such seals may be subject to degradation or not suitable. It may also reduce the costs and remove outgassing/permeability issues associated with such seals. This applies particularly to elastomer seals traditionally used to provide sealing between stator halves and end plates.

Optionally, the vacuum pump further comprises a thermal spacer positioned between the core pump assembly and the enclosure to thermally isolate the core pump assembly from the enclosure.

The thermal spacers allow the core pump assembly to be thermally separated from other pump components (e.g., outside of the enclosure). This can allow the core pump assembly to be maintained at a suitably hotter operating temperature (e.g., to avoid condensation of process gas therein), without negatively heating other pump components that are better suited to operating at lower temperatures.

In one example, the thermal spacer is positioned between and in contact with both the core pump assembly and the enclosure. In this manner, the thermal spacer is used to minimise the conduction of heat from the core pump assembly to the enclosure. In one example, the enclosure comprises radial walls and the thermal spacer is positioned between the radial walls and the core pump assembly.

Optionally, the thermal spacer comprises a ceramic material.

Ceramic material typically has a low thermal conductivity, and so minimises the conduction of heat between the core pump assembly and the enclosure. Any suitable ceramic material may be used, such as alumina ($Al_2O_3$), zirconia ($ZrO_2$), or magnesia (MgO). In alternative examples, any other suitable thermally insulating material may be used as a thermal spacer.

Optionally: the plurality of pump chambers include an inlet pump chamber configured to receive process gas from a vacuum system; the two stator halves extend between a first axial end face at a high vacuum, inlet side of the pump and a second, opposing axial end face at a low vacuum, outlet side of the pump and each define a radially inner face along which they are joined together; and at least one stator half includes a purge gas leakage channel that fluidly connects the first axial end face to a pump chamber downstream of the inlet pump chamber.

The purge gas leakage channel allows inert purge gas that might leak into the high vacuum, inlet stage of the core pump assembly (e.g., at the first axial end) to be fed into a lower vacuum stage instead. This allows purge gas leakage to be suitably removed through the pump whilst reducing its impact on the high vacuum efficiency and capabilities of the pump.

In one example, the purge gas leakage channel is provided in the bottom stator half; however, in other examples it can be provided in the top stator half instead or both the top and bottom stator halves.

It should be understood that the plurality of pump chambers are chambers where the compressive work of the pump is exerted on the process gas and thus define a plurality of pump stages. The inlet pumping chamber therefore corresponds to that of the inlet stage of the pump. The purge gas leakage channel can communicate with any pumping chamber that is not the inlet pumping chamber. As the inlet pumping chamber is the largest volume chamber, the downstream pumping chambers will be smaller in volume.

Optionally, the at least one stator half comprises a plurality of purge gas leakage channels that fluidly connect the first axial end face to different pump chambers downstream of the inlet pump chamber.

Optionally, the plurality of purge gas leakage channels are spaced radially apart, and a radially outward one of the purge gas leakage channels is fluidly connected to a pump chamber that is of a smaller volume than a pump chamber that a radially inward one of the purge gas leakage channels is fluidly connected to.

In this manner, a first of the plurality of purge gas leakage channels positioned radially outwards of a second of the plurality of purge gas leakage channels is fluidly connected to a pump chamber that is of a smaller volume than the second of the plurality of purge gas leakage channels is fluidly connected to. In a further example, a third of the plurality of purge gas leakage channels is positioned radially inwards of the second of the plurality of purge gas leakage channels and is fluidly connected to a pump chamber that is of a larger volume than the second of the plurality of purge gas leakage channels is fluidly connected to. Any suitable number of purge gas leakage channels can be used, for example, up to one for each pump chamber, except the inlet pump chamber.

A plurality of purge gas leakage channels connected to pump chambers of increasing volume allow for leakage gas to be collected across a range of decreasing pressures. This can allow purge gas to be collect in stages as it leaks into the core pump assembly, and thus provide improved amounts of leakage collection. This can further reduce the inert purge gas' impact on the high vacuum efficiency and capabilities of the pump.

Optionally, the purge gas leakage channel extends axially from the first axial end face and is substantially Z-shaped in cross-section.

In this manner, the purge gas leakage channel(s) can include a first axially extending section extending from the first axial end face, a first turn (e.g., a 90 degree turn) to a radially extending section, and a second turn (e.g., a 90 degree turn) to a second axially extending section that fluidly connects to the downstream pump chamber. This substantial Z-shape can help prevent leakage back through the purge gas leakage channel(s).

Optionally, the purge gas leakage channel further includes a portion of the channel that extends across the first axial end face.

In this manner, the purge gas leakage channel extends across the axial end face as well as along the radially inner face of the stator half(ves). This allows the purge gas leakage channel to collect more purge gas leakage from across the interface defined by the first axial end face (e.g., between the stator halves and the end pieces). In this manner, a higher amount of purge gas leakage may be removed and high vacuum efficiency improved further.

In examples where a plurality of gas leakage channels are provided, each of the gas leakage channels can include a respective portion extending across the first axial end face, and will be nested radially apart across the axial end face according to the radial spacing between the plurality of channels.

Optionally, the portion of the channel extending across the first axial end face fluidly connects opposing radial sides of the radially inner face.

In this manner, the portions of the gas leakage channels circumscribe a portion of the stator half(ves) and collect more of the purge gas leaking to at the interface defined by the first axial end face and communicate this to the chamber for removal.

The portion of the channel on the first axis end face can take any other suitable shape to connect the opposed radial sides of the radially inner face. In one example, the portion is substantially U-shaped in cross-section. In another example, the portion is substantially semi-circular in shape.

Optionally, the portion of the purge gas leakage channel on the first axial end face comprises a groove defined into the first axial end face.

Providing grooves in the first axial end face allow the purge gas leakage channel to be open to the interface between the stator halves and the end pieces to permit collection and removal of the purge gas therefrom. Providing grooves in the first axial end face may be a particularly simple way of implementing the portion of gas leakage channel therein. For example, it can be achieved by simply machining (e.g., milling) a portion of the first axial end face.

Optionally, the purge gas leakage channel comprises a pair of grooves defined into the radially inner face on opposing radial sides of the radially inner face.

In this manner, the pair of grooves are spaced at substantially the same radial distance from the longitudinal axis L of the pump 20 on opposing sides of the stator half(ves) and both open at the first axial end face and fluidly connect to the same downstream pump chamber.

The grooves in the radially inner face allow the purge gas leakage channel to be open to the interface between the stator halves to permit collection and removal of purge gas that might leak into the core pump assembly via the interface. In this manner, a higher amount of purge gas may be removed and high vacuum efficiency improved further. Moreover, providing grooves in the radially inner face of the stator half is a particularly simple way of implementing the gas leakage channel. For example, it can be achieved by simply machining (e.g., milling) a portion of the radially inner face.

Optionally, the core pump assembly further comprises end pieces joined to the opposed first and second axial end faces.

In this manner, the axial end faces interface with the stator halves and help seal the core pump assembly.

Optionally, the core pump assembly does not comprise any elastomer seals.

Owing to the various features of the pump configuration of the present disclosure, elastomer seals can be removed from the core pump assembly altogether. This includes longitudinal seals between the radially inner faces of the stator halves (i.e., seals extending axially along the interface between the stator halves), annular seals in the end pieces that interface with the first and second axial end faces of the stator halves and T-joint seals that join the longitudinal seals and annular seal.

In some examples, to help protect from purge gas leakage, longitudinal, annular, T-joint seals may nevertheless be provided in the core pump assembly. However, their sealing effectiveness is less of a concern, and so they may be non-elastomer seals and be cheaper to implement.

Optionally, the vacuum pump further comprises: a motor; a gear cover; and an end cover, wherein each of the motor, the gear cover and the end cover are located outside of the enclosure.

By placing the motor, gear cover and end cover outside of the enclosure, they can be kept at cooler operating temperatures than the core pump assembly. This can improve the lifetime and operating characteristics of these components.

Optionally, the vacuum pump further comprises a pair of head plates for supporting a rotor assembly of the pump, wherein the pair of head plates are spaced apart from the core pump assembly.

Head plates are known to contain bearings and/or seals that support the rotor assembly (e.g., rotor shafts) during pump operation. By spacing the head plates away from the core pump assembly, they can be kept at cooler operating temperatures than the core pump assembly. This can improve the lifetime and operating characteristics of the head plates and their contents, e.g., bearing lubrication and seal integrity therein can be better maintained. In one example, the head plates are spaced axially apart from the core pump assembly.

In further examples, the head plates are separated from the core pump assembly by the thermal spacer. In such examples, the head plates can be in contact with the thermal spacer. This helps to keep the head plates cool by minimising conduction from the core pump assembly thereto.

In yet further examples, the head plates form walls of the enclosure e.g., to which a top and bottom covers of the enclosure are fitted. This can simplify pump design and keep the enclosure more compact. In other examples, the head plates can instead be placed outside the enclosure or instead be placed inside the enclosure. In such examples, the enclosure is formed of walls and covers that are separate to the head plates or are formed using other pump components (e.g., gear cover and end cover) and covers. Placing the head plates outside the enclosure can help further reduce the temperature thereof.

BRIEF DESCRIPTION OF DRAWINGS

Various examples will now be described, by way of example only, and with reference to the accompanying drawings.

DETAILED DESCRIPTION

Figure 1A:
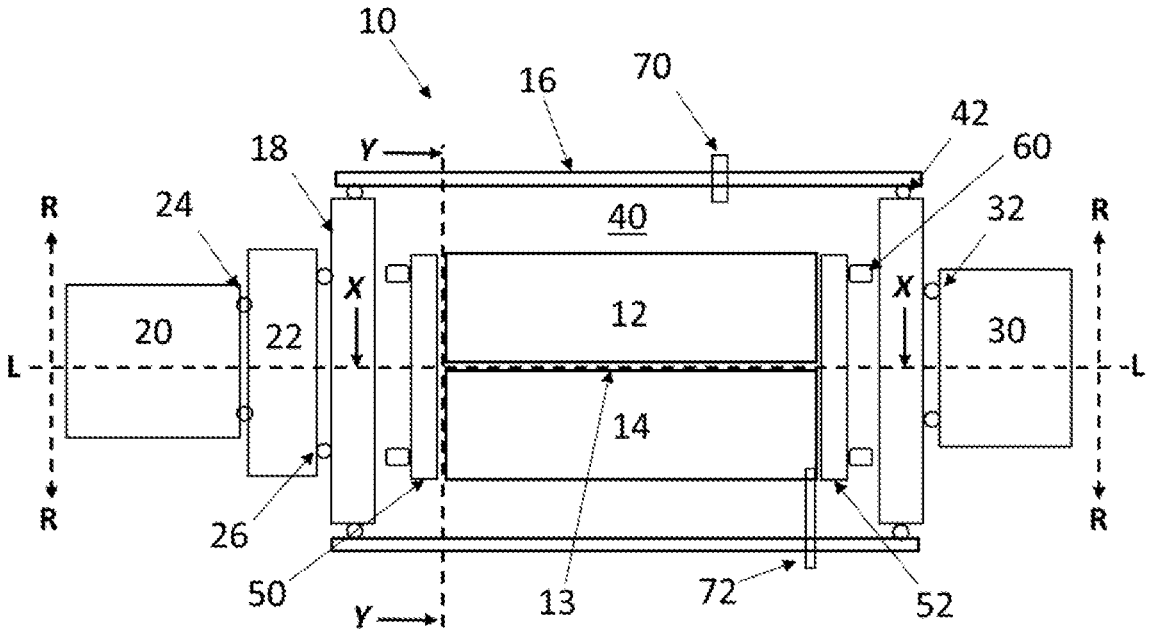
FIG. 1*a* shows an exemplary pump assembly in accordance with an example of this disclosure.
Figure 1B:
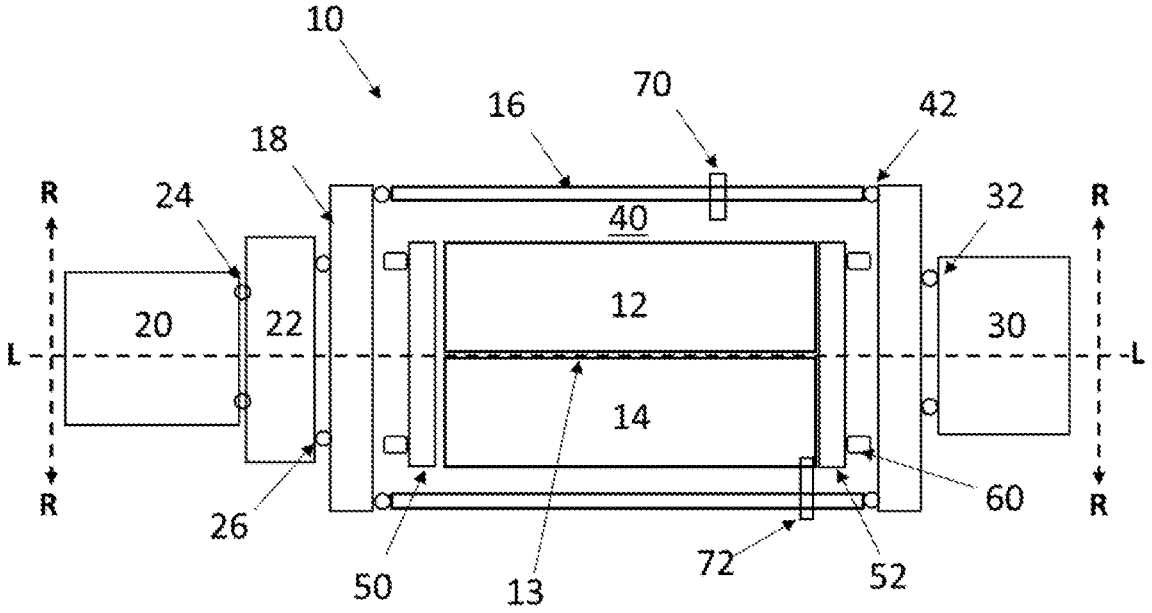
FIG. 1*b* shows another exemplary pump assembly in accordance with an example of this disclosure.

With reference to FIGS. 1*a* and 1*b*, a multi-stage vacuum pump 10 comprises a first stator component 12 and a second stator component 14, between which a rotor assembly (not shown) is mounted.

The two stator components 12, 14 are fixed together to form the pump chambers 80*a-g* therein (shown in FIGS. 2 and 3 discussed below). In this manner, the two stator components 12, 14 are known as stator halves 12, 14 (i.e., stator "clamshell" halves 12, 14), and are joined together along an interface 13 defined by radially inner faces 13*a*, 13*b* of the stator halves 12, 14.

The pump 10 defines a central longitudinal axis L along which the stator halves 12, 14 extend and a radial direction R perpendicular thereto. The interface 13 is provided along the longitudinal axis L.

The rotor assembly can be any suitable type of rotor assembly and in the depicted examples will generally include two counter-rotating shafts with rotors mounted on each shaft (not shown). The rotors interact within the chambers 80*a-g* to pump working/process gas through the pump from an inlet at high-vac chamber 80*a* to an outlet at low-vac chamber 80*g*. The rotor assembly can be any suitable type of rotor assembly, and may form, for example, a Claw type vacuum pump, a Roots type vacuum, or a combination thereof. As such rotor assemblies are generally known and not the focus of the present disclosure, they will not be discussed further in detail.

End pieces 50, 52 are mounted on opposed axial ends of the two stator components 12, 14 to complete a core pump assembly. It will be appreciated that the core pump assembly is thus the part of the vacuum pump 10 within which the compression and pumping of process gas between chambers 80*a-g* is to take place.

Notably, whereas traditional vacuum pumps would comprise longitudinal seals between the two stator components 12, 14 and annular seals between the stator components 12, 14 and the end pieces 50, 52, these are not required in the vacuum pump 10 of the present disclosure.

The core pump assembly (defined by the two stator components 12, 14 and the two end plates 50, 52) is located within a sealed enclosure 40, which in the depicted example is defined by enclosure covers 16 and head plates 18. The two head plates 18 are located axially on either side of the core pump assembly and comprise bearings and seals for the shafts (not shown) of the rotor assembly. The two enclosure covers 16 are located radially on either side of the core pump assembly (i.e., above and below the core pump assembly) and extend axially between the two head plates 18 to form the enclosure 40. Seals 42 are provided between the enclosure covers 16 and the head plates 18 to ensure that the enclosure 40 is substantially hermetically sealed. In other words, the enclosure 40 is sealed in a substantially gas-tight manner, such that a pressure difference between the interior of the enclosure 40 and the surrounding atmosphere can be maintained when the pump 10 is operational. The placement of the enclosure covers 16 and seals 42 may be such that the enclosure 40 is hermetically sealed from the environment whilst allowing for differential thermal expansion between the head plates 18 and the enclosure covers 16 is formed. For example, a piston seal arrangement, as shown in FIG. 1*a*, and/or a face seal arrangement, as shown in FIG. 1*b*. Unlike the core pump assembly, the seals 42 may comprise elastomer seals or any other suitable type of seal (e.g., non-elastomer).

Outside of the enclosure 40, the vacuum pump 10 further comprises a motor 20 and an end cover 30, between which the shafts of the rotor assembly extend, and a gear cover 22 located axially between the motor 20 and the head plate 18 (nearest the end piece 50), which houses gearing (not shown) for the rotor assembly. Each of the motor 20, the gear cover 22, and the end cover 30 comprise seals 24, 26, 32 to maintain a seal between these components, and to help further seal the enclosure 40 from the environment. In alternative examples, the enclosure covers 16 may extend axially between any element of the pump 10, for example, the gear cover 22 and the end cover 30, such that the enclosure 40 includes these components therein. In such examples, additional plates would be placed axially outboard of these components and placed in sealing connection with the covers 16, instead of using head plates 18. In further alternative examples, the enclosure 40 may enclose components of the pump 10.

During operation of the vacuum pump 10, the operating temperature of the core pump assembly can typically be between 200-400° C. (e.g., to avoid process gas condensation therein), whilst the suitable temperature for the bearings, gearing, motor and elastomer seals can typically be less than 150° C. To help maintain the appropriate temperatures for each component during operation, thermal spacers 60 are provided between the end pieces 50, 52 and their respective head plates 18. In this manner, the thermal spacers 60 can be used to reduce the conduction of heat from the core pump assembly to the head plate 18 and other lower operating temperature pump components. Accordingly, the thermal spacers 60 may comprise any material with a suitably low thermal conductivity, e.g., a ceramic material, and may have a relatively small cross sectional area to further minimise the heat transfer between the end pieces 50, 52 and the head plates 18. The shafts of the rotor assembly may also comprise thermal breaks to help prevent heat being transferred outside of the core pump assembly via the shafts.

The vacuum pump 10 further comprises an inert purge gas inlet 70 fluidly connected to the enclosure 40. In the depicted example, the inert purge gas inlet 70 passes through the top housing cover 16. The inert gas inlet 70 allows for an inert gas, such as nitrogen, to be fed into and fill the interior of the enclosure 40. The inert gas will be supplied to the inlet 70 via an inert purge gas line (not shown). The temperature of the purge gas may be chosen to be any temperature suitable for the application. For example, the purge gas may be heated to help the core pump assembly get up to and maintain the correct operating temperature (e.g., to avoid process gas condensation).

Purge gas being inert may prevent the purge gas from having any negative or unwanted effects with the pump 10 and the process gas therein. Although nitrogen is exemplified, any other suitable inert gas could be used, e.g., argon.

It is to be appreciated that the inert purge gas inlet 70 is separate and distinct from a process gas inlet (not shown) that is fluidly connected to the core pump assembly for communicating process gas thereto (i.e., to the inlet (high-vac) stage 80*a*). Such a process gas inlet will also pass through the enclosure 40, but it will be fluidly connected to the pump inlet (not shown) defined through the stator components 12, 14, and will not be fluidly connected with the interior space of the enclosure 40 such that it can be filled with purge gas, as is the case for inert purge gas inlet 70.

Inert purge gas enters the enclosure 40 through the inlet 70 and is subsequently removed through an exhaust 72. The exhaust 72 is a duct or pipe that passes through the enclosure 40, and in the depicted example, is fluidly connected to the exhaust of the core pump assembly. In other words, it is connected to the outlet of the low-vac (i.e., outlet) stage 80*g*, and is not fluidly open to the interior of the enclosure 40.

In this example, an inert purge gas removal passage 90 is defined through the stator component 14 (see FIGS. 2 and 3) and is in fluid communication with the inlet of the low-vac stage 80*g*. In this manner, the purge gas in the enclosure 40 is removed by feeding it into the inlet of the low-vac stage 80*g* via the passage 90, where it will travel through the low-vac stage 80*g* and be communicated to the exhaust 72, along with the process gas also passing through the low-vac stage 80*g*. In alternative examples, the purge gas can be fed into the outlet of the low-vac stage 80*g* rather than its inlet, or fed into the exhaust 72 directly. In other examples, any other suitable arrangement (e.g., pipe and/or passage) can be used to achieve the removal of purge gas from the enclosure 40 via the exhaust 72.

A pressure and/or temperature sensor may be incorporated into the pump 10 for monitoring the pressure and/or temperature of the purge gas inside the enclosure 40. The sensors can communicate with a purge gas flow rate controller (e.g., a flow control valve placed in the inlet 70 and/or passage 90) to maintain a desired pressure and/or temperature inside the enclosure 40 by controlling the flow of the inert purge gas in and/or out of the enclosure 40. Any appropriate pressure and/or temperature sensor may be employed, and any suitable flow controller, such as a flow control valve or pressure control valve (pressure regulator) can be used.

It is to be appreciated that having the enclosure 40 sealed around the core pump assembly and providing and maintaining a desired amount of inert gas therein (e.g., via inlet 70 and exhaust 72) allows a positive pressure differential to be maintained around the core pump assembly. This helps minimise leakage of process gas from the core pump assembly despite it not being provided with any seals, as well as prevent the ingress of atmospheric gases from the environment entering the enclosure 40. It is also to be appreciated that this sealing configuration may also be more resilient to changes in operating temperature and corrosive process gas than applications which use seals, as well as removing the potential outgassing, permeability and cost issues associated with employing several elastomer seals in the core pump assembly instead.

Moreover, the enclosure 40 in combination with the thermal spacers 60 can permit the separation of different components that have different operating temperature limits. For example, the shaft bearings and seals in the head plates 18 can be maintained at lower operating temperatures than that of the core pump assembly. This can help improve the lifetime and running characteristics of the different pump components.

Figure 2:
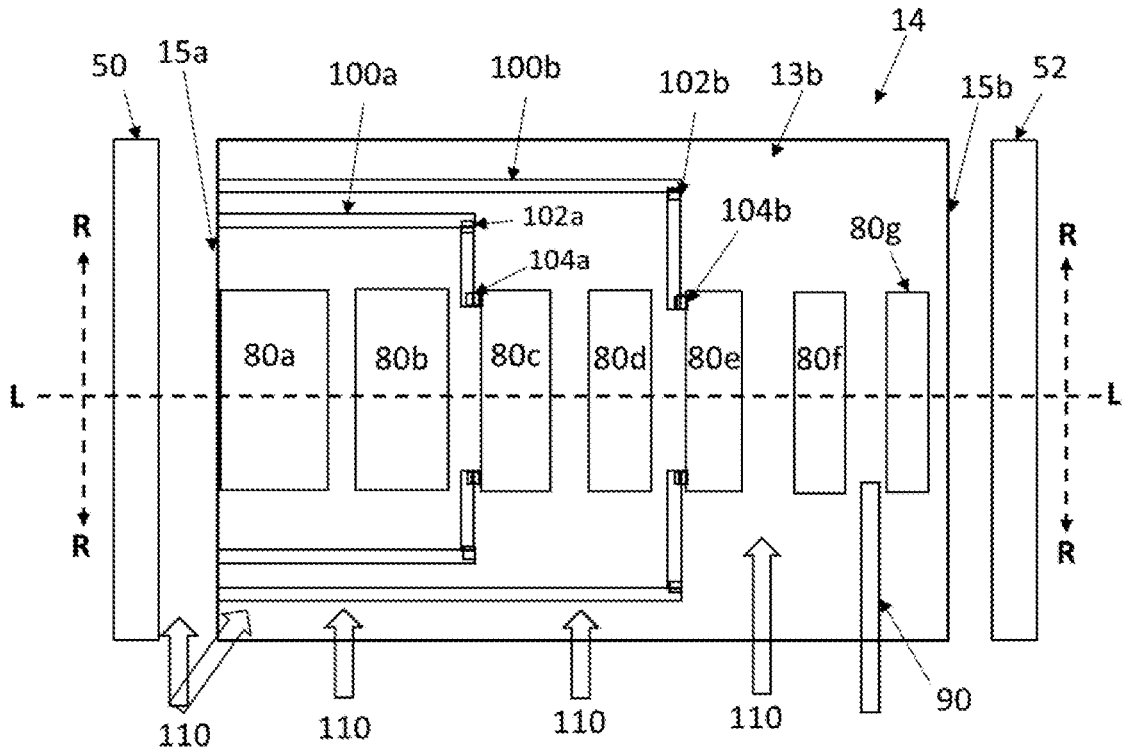
FIG. 2 shows an exemplary cross-section of a core pump assembly stator in accordance with an example of this disclosure taken across line X-X in FIG. 1*a*.

Referring now to FIG. 2, a cross-section along line X-X in the core pump assembly in FIG. 1*a* is shown. This cross-section shows the radially inner face 13*b* of the second stator component 14, which allows the pump chambers 80*a-g* to be visible. Whilst the following example will be described in relation to the second stator component 14, it should be understood that the same can also (though not necessarily) apply to the first stator component 12, which will have a corresponding radially inner face 13*a* (not shown).

The stator components 12, 14 are joined across the interface 13 defined by respective radially inner faces 13*a*, 13*b* to form the core pump assembly. Accordingly, each stator component 12, 14 comprises half of each pump chamber 80*a-g*, such that when joined together to form the core pump assembly, the pump chambers 80*a-g* are formed. As discussed above, in the example shown, the inert purge gas is removed from the enclosure 40 using the passage 90 that is fluidly connected to the inlet of the outlet (or low-vac) chamber 80*g*.

As can be seen from FIG. 2, the pump chambers 80*a-g* successively decrease in size in the axial direction with the largest volume, inlet (or high-vac) pump chamber 80*a* being closest to the motor 20 and the smallest volume, outlet (or low-vac) pump chamber 80*g* being closest to the end cover 30. The inlet pump chamber 80*a* is configured to receive process gas from a vacuum system via a process gas inlet and the outlet pump chamber 80*g* is configured to exhaust process gas from the core pump assembly via an outlet (discussed above). The gradual decrease in volume from chambers 80*a*-80*g* corresponds to an equivalent gradual increase in pressure from the desired operating pressure of the vacuum to atmospheric pressure. By employing multiple pump chambers, and thus multiple stages of compression, pumping efficiency is improved and higher vacuum pressures may be maintained.

As also shown, the stator components 12, 14 extend axially between opposed axial end faces 15*a*, 15*b* to which end pieces 50, 52 are joined. In this manner, the end pieces 50, 52 can be said to provide an interface with the stator components 12, 14 along faces 15*a*, 15*b*, respectively. Moreover, given their positioning relative to the chambers 80*a*-80*g*, the first axial end face 15*a* is at the high vacuum, inlet side of the pump 10 and the second, opposing axial end face 15*b* is at the low vacuum, outlet side of the pump 10.

Due to the lack of seals between the first and second stator components 12, 14 and between the stator components 12, 14 and the end pieces 50, 52, inert purge gas from the enclosure 40 can leak into the core pump assembly. If no measures are implemented to prevent this, the efficiency of the pump 10 may be reduced, as leaked purge gas 110 can enter the pump chambers 80*a-g* and be compressed along with the process gas therein, increasing the compressive work.

To combat this effect, the present example further comprises purge gas leakage channels 100*a* and 100*b* in the stator component 14 that extend from the first axial end 15*a* that interfaces with the end piece 50 at the high vacuum, inlet side of the pump 10 to the third and fifth pump chambers 80*c*, 80*e*, respectively. Whilst the present example depicts two purge gas leakage channels 100*a*, 100*b*, examples comprising between 1 and n−1 purge leakage channels are envisaged, with n being the number of pump stages 80. Furthermore, whilst the channels 100*a*, 100*b* are shown connected to the third and fifth pump chambers 80*c*, 80*e*, the channels 100 may be connected to any of the pump chambers 80, as long as it excludes the inlet (high-vac) pump stage 80*a*.

The purge gas leakage channels 100*a*, 100*b* serve to capture purge gas 110 that leaks into the core pump assembly. As the channels 100*a*, 100*b* are connected to the pump chambers 80*c*, 80*e* respectively, this means that the leaked gas 110 entering the channels 100*a*, 100*b* is pumped by the pump stage 80*c*, 80*e* along with the process gas. For example, the leaked gas 110 at the high-vac inlet end of the pump 10, i.e. closer to the end piece 50, will first come into contact with the channel 100*b*. Channel 100*b* is connected to the pump chamber 80*e*, which may be pressurised at, for example, around 100 mbar. Therefore, the leaked gas 110 is driven into the pump chamber 80*e* until the pressure in the channel 100*b* is also 100 mbar. The leaked gas 110, now at a pressure of 100 mbar, may continue to flow radially inwards. In doing so, it will then come into contact with the channel 100*a*. Channel 100*a* is connected to the pump chamber 80*c*, which is pressurised at a lower pressure of, for example, around 10 mbar. As with the channel 100*b*, this means that the flow of leaked gas 110 is reduced to a pressure of 10 mbar. As such, assuming the leaked gas 110 was initially at atmospheric pressure (~1 bar), the amount of leakage has been reduced to $1/100^{th}$ of its original pressure. By reducing the pressure of the leaked gas 110 in this way, this ensures that when the leaked gas 110 comes into contact with the lowest-pressure pump stages 80*a*, 80*b*, the additional work by these stages 80*a*, 80*b* to compress the leaked gas 110 is significantly reduced.

It will be appreciated that in the depicted configuration, owing to the relative gas pressures present, a radially inner channel 100 may be connected to a larger volume pump chamber 80 than a channel 100 that is radially outwards thereof in order for the inner channel 100 to provide a benefit.

The channels 100*a*, 100*b* depicted resemble substantially a Z-shape in cross-section such that they each comprise two turns 102, 104. These turns 102, 104 may help prevent leakage out of the core pump assembly via the channels 100*a*, 100*b*. However, the channels 100*a*, 100*b* can have any suitable shape for capturing and transporting the leaked gas 110 to the corresponding pump chamber 80.

Furthermore, the channels 100*a*, 100*b* are illustrated as connecting axially into the pump chamber 80. In the present example, this is due to the inaccessibility of the inter-stage ports of each pump stage 80, with them being between the two parallel shafts of the rotor assembly. However, in examples where the inlet of the pump stages 80 are not between the two shafts, it is envisaged that the channels 100*a*, 100*b* may be connected to the inlet for that pump stage (i.e., the inlet that carries process gas to the pump stage for compression).

The channels 100*a*, 100*b* depicted resemble substantially a Z-shape in cross-section such that they each comprise two turns, e.g., channel 100*a* including first turn 102*a*, and second turn 104*a* and/or channel 100*b* including first turn 102*b* and second turn 104*b*. These turns 102*a*, 104*a*, 102*b*, 104*b* may help prevent leakage out of the core pump assembly via the channels 100*a*, 100*b*. However, the channels 100*a*, 100*b* can have any suitable shape for capturing and transporting the leaked gas 110 to the corresponding pump chamber 80.

Figure 3:
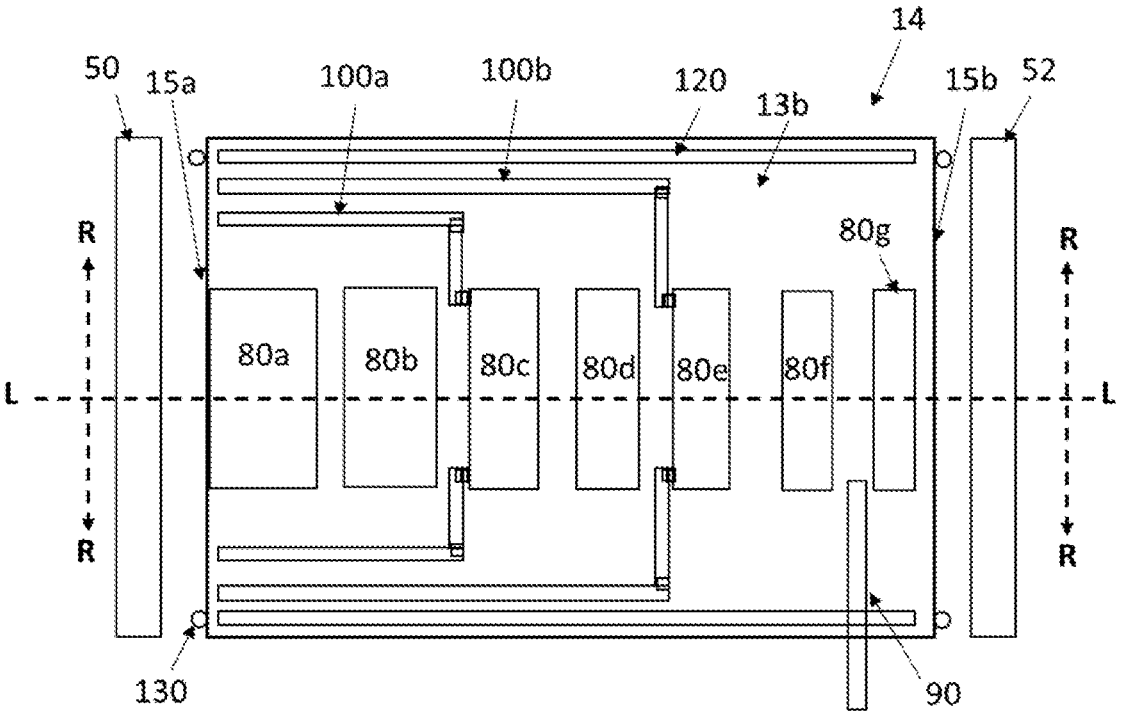
FIG. 3 shows another exemplary stator in accordance with an example of this disclosure.

Referring now to FIG. 3, the pump 10 may combine the channels 100 with conventional sealing methods, such as longitudinal seals 120 and/or annular seals 130. The longitudinal seals 120 may extend in a groove in the stator component 12, 14 from the high-vac end piece 50 to the low-vac end piece 52 radially outwards of the channels 100. The longitudinal seals 120 and their grooves may be discontinuous to prevent fluidly connecting the two ends of the core pump assembly. The annular seals 130 are located between the end pieces 50, 52 and the stator components 12, 14 and comprise a diameter that positions them radially outwards of the channels 100. The purpose of these optional seals is to reduce the amount of leaked gas 110 that reaches the radially-outermost channel 100*b* and thus reduce the amount of work by the pump stage 80*e* that said channel 100*b* is connected to, further increasing the efficiency of the pump 10. However, the sealing system 120, 130 of the core pump assembly of this example may not be as accurate or as robust as conventional sealing systems, as any leakage into the core pump assembly through the seals 120, 130 will be reduced by the channels 100 as described above. This means that accurate alignment between the two stator components 12, 14 and between the stator components 12, 14 and the end pieces 50, 52 are not required. Furthermore, this means that the seals 120, 130 may comprise either elastomer or non-elastomer seals as opposed to conventional sealing systems where elastomer seals are a requirement.

Figure 4:
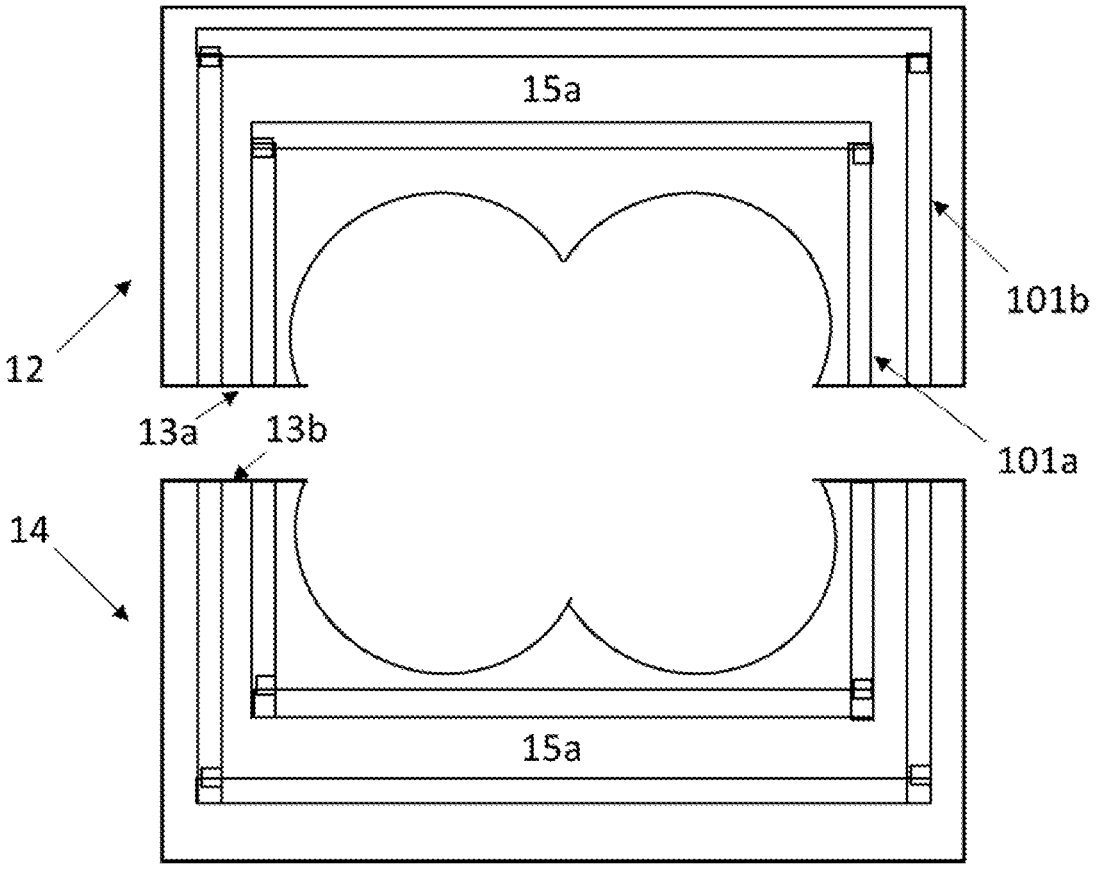
FIG. 4 shows another exemplary cross-section of a core pump assembly stator in accordance with an example of this disclosure taken across line Y-Y in FIG. 1*a*.

With reference to FIG. 4, a cross-section along line Y-Y in the core pump assembly in FIG. 1*a* is shown, looking towards the first axial end face 15*a* of the two stator components 12, 14. The purge gas leakage channels 100*a*, 100*b* can be seen to further comprise portions 101*a*, 101*b* that extend across the first axial end face 15*a* of the stator components 12, 14. This can allow additional purge gas leakage to be collected at the interface defined by the first axial end face 15*a* (i.e., the interface between the stator components 12, 14 and the end piece 50).

In the depicted example, the portions 101*a*, 101*b* are used to fluidly connect opposed radial sides of the radially inner faces 13*a*, 13*b*, and thus are fluidly connected to the parts of the channel 100*a*, 100*b* in the radially inner faces 13*a*, 13*b*. In this manner, the portions 101*a*, 101*b* circumscribe portions of the stator components 12, 14 at the first axial end face 15*a* and collect purge gas leaking to the first axial end face 15*a* and communicate this to the part of the channel 100*a*, 100*b* in the radially inner faces 13*a*, 13*b*. This allows the purge gas leakage channels 100*a*, 100*b* to collect more leaked gas 110 that may leak into the interface between the stator components 12, 14 and the end piece 50, as the portions 101*a*, 101*b* circumscribing the first axial end face 15*a* extend substantially around 360 degrees at the interface with the end plate 50.

In this manner, a higher amount of leaked gas 110 may be prevented from entering the lowest-pressure pump stages 80*a*, 80*b* and thus the high vacuum efficiency of the pump 10 may be improved further.

The portions 101*a*, 101*b* shown in FIG. 4 are substantially U-shaped but may take any other suitable shape to connect the opposed radial sides of the radially inner faces 13*a*, 13*b*, for example, a semi-circular shape. As shown, the portions 101*a*, 101*b* comprise different radii such that they are nested radially apart across the first axial end face 15*a*.

The portions 101*a*, 101*b* shown are provided as grooves connecting the opposing radial sides of the first axial end face 15*a* of the stator components 12, 14. These grooves can be machined (e.g., milled) into the first axial end face 15*a* of the stator components 12, 14. However, can take any other suitable form for capturing and transporting the leaked gas 110 across the first axial end face 15*a*.

Whilst the present disclosure has been described in the context of a clamshell stator construction with pump chambers defined therein (e.g., Roots and claw type pumps), it is envisaged that the present disclosure could also be applied to other pumps where seal-free designs may be desirable. For example, a screw pump could incorporate similar channels to those described herein, but connecting the channels to different locations along the length of the screw. In the context of a screw pump, different screw length locations are to be seen as an equivalent to the different pump chambers 80*a*-80*g* discussed in the present disclosure.

The invention claimed is:

1. A vacuum pump comprising:

a substantially hermetically sealed enclosure;

a core pump assembly located within the enclosure and comprising two stator halves that are joined to define a plurality of pump chambers therein; and an inert purge gas inlet fluidly connected to the enclosure for supplying inert purge gas to an interior of the enclosure surrounding the core pump assembly, wherein the plurality of pump chambers include an inlet pump chamber configured to receive process gas from a vacuum system, the two stator halves extend between a first axial end face at a high vacuum, inlet side of the vacuum pump and a second, opposing axial end face at a low vacuum, outlet side of the vacuum pump and each define a radially inner face along which they are joined together, and at least one stator half includes a purge gas leakage channel that fluidly connects the first axial end face to a pump chamber downstream of the inlet pump chamber.

2. The vacuum pump of claim 1, further comprising a thermal spacer positioned between the core pump assembly and the enclosure to thermally isolate the core pump assembly from the enclosure.

3. The vacuum pump of claim 2, wherein the thermal spacer comprises a ceramic material.

4. The vacuum pump of claim 1, wherein the at least one stator half comprises a plurality of purge gas leakage channels that fluidly connect the first axial end face to different pump chambers downstream of the inlet pump chamber.

5. The vacuum pump of claim 4, wherein the plurality of purge gas leakage channels are spaced radially apart, and a radially outward one of the purge gas leakage channels is fluidly connected to a pump chamber that is of a smaller volume than a pump chamber that a radially inward one of the purge gas leakage channels is fluidly connected to.

6. The vacuum pump of claim 1, wherein the purge gas leakage channel extends axially from the first axial end face and includes at least a first turn and a second turn.

7. The vacuum pump of claim 1, wherein the purge gas leakage channel further includes a portion of the channel that extends across the first axial end face.

8. The vacuum pump of claim 7, wherein the portion of the channel extending across the first axial end face fluidly connects opposing radial sides of the radially inner face.

9. The vacuum pump of claim 7, wherein the portion of the purge gas leakage channel on the first axial end face comprises a groove defined into the first axial end face.

10. The vacuum pump of claim 1, wherein the purge gas leakage channel comprises a pair of grooves defined into the radially inner face on opposing radial sides of the radially inner face.

11. The vacuum pump of claim 1, wherein the core pump assembly further comprises end pieces joined to the opposed first and second axial end faces.

12. The vacuum pump of claim 1, further comprising:

a motor;

a gear cover; and an end cover;

wherein each of the motor, the gear cover and the end cover are located outside of the enclosure.

13. The vacuum pump of claim 1, further comprising a pair of head plates for supporting a rotor assembly of the vacuum pump, wherein the pair of head plates are spaced apart from the core pump assembly.

* * * * *